United States Patent [19]

Ogibayashi et al.

[11] Patent Number: 4,747,445

[45] Date of Patent: May 31, 1988

[54] CONTINUOUS CASTING METHOD

[75] Inventors: Shigeaki Ogibayashi, Kimitsu; Kenichi Miyazawa, Kawasaki, both of Japan

[73] Assignee: Nippon Steel Corporation, Tokyo, Japan

[21] Appl. No.: 93,000

[22] Filed: Sep. 4, 1987

[30] Foreign Application Priority Data

Sep. 4, 1986 [JP] Japan ..... 61-206749

[51] Int. Cl.[4] ..... B22D 11/00

[52] U.S. Cl. ..... 164/476; 29/527.7; 148/2

[58] Field of Search ..... 164/476; 29/527.7; 148/2

[56] References Cited

U.S. PATENT DOCUMENTS 3,974,559 8/1976 Kawawa et al. ..... 29/527.7

4,687,047 8/1987 Ogibayashi et al. ..... 164/476

*Primary Examiner*—Kuang Y. Lin

*Attorney, Agent, or Firm*—Wenderoth, Lind & Ponack

[57] ABSTRACT

A method of continuously casting molten metal by continuously drawing a strand, wherein the thickness of said strand is continuously reduced at a reduction rate (x) in a region between a point of time when the center of said strand has a temperature corresponding to a solid-phase ratio of 0.1 to 0.3 and a point of time when said temperature has dropped to a level corresponding to a solid-phase ratio at a limit of fluidization, provided that said reduction rate (x) satisfies the following equation (1):

$$0.6\xi \leqq x \leqq 1.1\xi \quad (1)$$

where $\xi = 4/r$, $1 \leqq r \leqq 4$, r is a flatness ratio of the strand, x is a reduction rate (mm/min).

9 Claims, 1 Drawing Sheet

CONTINUOUS CASTING METHOD

BACKGROUND OF THE INVENTION

1. Field of the Invention

The present invention relates to a continuous casting method which is capable of producing a homogeneous continuous-cast section of a strand, that is directly obtained from molten metal by continuous casting and which has a liquid core, while preventing segregation of impurity elements (e.g. sulfur, phosphorus and manganese in the case of a continuous-cast steel section) from occurring in the center of the thickness of the section.

2. Description of the Prior Art

As marine constructions, reservoirs, steel pipes for transporting oil and gas, and high-tensile wire rods are required to be built of steel materials that have better performance, it has become increasingly important to provide homogeneous steel materials. Theoretically, steel materials should have a uniform composition across their thickness, but steels generally contain impurity elements such as sulfur, phosphorous and manganese, which segregate during casting to provide a brittle steel where they are locally enriched. The use of the continuous casting processes has increased today with a view to achieving higher production rate, yield and saving energy, but pronounced compositional segregation is often observed in the center of the thickness of the strand produced by the continuous casting process. It is highly desirable to reduce the occurrence of center segregation because not only does it significantly impair the homogeneity of the final product but it also causes a serious defect such as cracking by exerting stress on the steel during service of the product or while it is drawn into a wire rod. The mechanism behind the occurrence of center segregation is as follows: the steel that remains unsolidified at the final stage of solidification flows owing to such factors as the force of shrinkage due to solidification and is progressively enriched by washing out the enriched melt present between dendrites in the vicinity of the solid-liquid interface. Therefore, in order to prevent center segregation, it is important to eliminate the causes of fluidization of the residual molten steel. The residual molten steel will flow not only by shrinkage due to solidification but also by the bulging of the strand between rolls and misalignment of the rolls. Of these factors, shrinkage due to solidification is most influential and, in order to prevent center segregation, the thickness of the strand (from which a slab, bloom or billet is obtained) must be reduced by the amount that is necessary to compensate for this phenomenon.

Attempts have been commonly made to avoid segregation by reducing the thickness of a cast steel strand. See, for example, U.S. Pat. No. 3,974,559 wherein the strand being continuously cast is reduced in thickness at a rate not smaller than what is sufficient to compensate for the shrinkage during solidification for the interval during which the temperature of the center of the strand drops from the liquidus line to the solidus line.

However, this method is not completely satisfactory for the purpose of preventing center segregation because little improvement is achieved under certain conditions, or segregation is increased, rather than decreased, in some cases.

SUMMARY OF THE INVENTION

It is an object of the present invention to provide a continuous casting method that is free from the above problems inherent in the prior art and which is capable of producing a homogeneous steel material, for example such as a slab, bloom and billet.

The inventors of the present invention conducted thorough investigation of the cause of the problems that occur in the prior art and have found that the prior art can achieve little improvement or it sometimes increases, rather than decreases, the center segregation because the time schedule of solidification for performing reduction in thickness and the range thereof are essentially inappropriate.

On the basis of the above finding, the present inventors have invented a method of continuously casting molten metal by continuously withdrawing a strand, characterized in that the thickness of the strand is continuously reduced at a rate of 0.5 mm/min to less than 2.5 mm/min in the region between the point of time when the center of the strand has a temperature corresponding to a solid-phase ratio of 0.1 to 0.3 and the point of time when said temperature has dropped to a level corresponding to the solid-phase ratio at the limit of fluidization, while substantially no reduction in thickness is effected in the region between the point of time when the center of the strand has a temperature corresponding to the solid-phase ratio at the limit of fluidization and the point of time when said temperature has dropped to the solidus line. Such method is disclosed in U.S. patent application Ser. No. 892,075, now U.S. Pat. No. 4,687,047 and European Patent Application No. 86 11 0690.4.

As the result of further research, the inventors of the present invention have found that there are optimum values in reduction rate, depending on a flatness ratio of the strand, in case that the thickness of the strand is continuously reduced in the region between the point of time when the center of the strand has a temperature corresponding to a solid-phase ratio of 0.1 to 0.3 and the point of time when said temperature has dropped to a level corresponding to the solid-phase ratio at the limit of fluidization, and on the basis of this finding, the present invention has been made.

Thus, the present invention provides a method of continuously casting molten metal by continuously drawing a strand, characterized in that the thickness of the strand is continuously reduced at a reduction rate (x) in the region between the point of time when the center of the strand has a temperature corresponding to a solid-phase ratio of 0.1 to 0.3 and the point of time when said temperature has dropped to a level corresponding to the solid-phase ratio at the limit of fluidization, provided that said reduction rate (x) satisfies the following equation (1):

$$0.6\xi \leqq x \leqq 1.1\xi \quad (1)$$

where $\xi = 4/r$, $1 \leqq r \leqq 4$, r is the flatness ratio of the strand, x is the reduction rate (mm/min).

The method can be conducted so that the reduction rate (x) is more than (or above) 2.5 mm/min while being kept within a range satisfying said equation (1); or so that the reduction rate (x) is less than 2.5 mm/min while being kept within a range satisfying said equation (1).

In the above method of the continuous casting of molten metal:

the term "molten metal" means at least one molten material of metals and/or alloys such as steel;

the term "solid-phase ratio" means the proportion of the solid phase in the center of the strand (and it means the term "fraction of solid");

the term "solid-phase ratio at the limit of fluidization" means an upper limit of the solid-phase ratio permitting the molten metal to flow, and is within a range of from 0.6 to 0.9, preferably within a range of from 0.6 to 0.8;

the phrase "the thickness of the strand is continuously reduced" means that the thickness of the strand is continuously decreased by passage, at a specified rate, through, for example, at least two pairs of upper and lower rolls in a continuous casting machine; and the term "flatness ratio" means a ratio of width to thickness in the strand.

DESCRIPTION OF THE PREFERRED EMBODIMENTS

Hereinbelow will be described in detail embodiments of the method of the present invention with reference to the drawings.

Reduction in thickness under light conditions as described in U.S. Pat. No. 3,974,559 is an effective method for obtaining a steel strand having no center segregation. However, according to the findings of the inventors of the present invention, the region of the cast strand where its thickness should be reduced and the reduction rate at which the thickness of the cast strand should be reduced in such region are most important factors for this approach.

First will be described the reduction rate of the cast strand.

Figure 2:
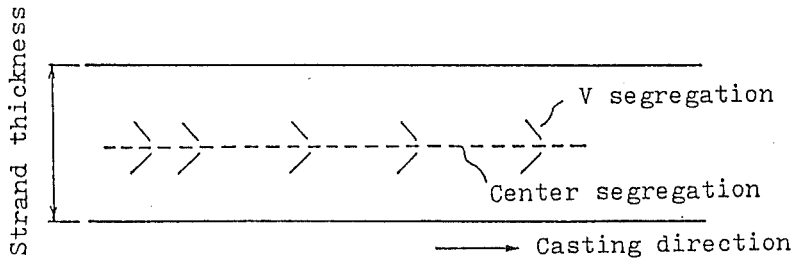
FIG. 2 is a schematic view of the continuous cast strand provided with both the center segregation and the V-shaped segregation.

The continuously cast strand usually contains not only the center segregation but also a V-shaped segregation (hereinafter referred to as the V segregation) as shown in FIG. 2. The V segregation occurs as a result of shrinkage due to solidification and the number of V segregations that have developed can be used as an index for the sufficiency of reduction in thickness with respect to the amount of shinkage due to solidification. As a result of close observation of the V segregation, the present inventors have found the following two facts. The first fact relates to how the amount of reduction in thickness should be considered. According to the finding of the inventors what is important for the purpose of compensating for the shrinkage due to solidification is not the amount of reduction (in mm) achieved by one roll, but the average reduction rate (mm/min) for the range of several meters in the vicinity of the crater end (the end solidification). The term "reduction rate" may be defined as the amount by which an arbitrary point on the cast strand is reduced in thickness per unit time as it passes through a plurality of roll pairs. Assuming the roll gap setting in actual casting operations, the reduction gradient (mm/m), i.e., the reduction rate divided by the casting speed, may be used as the amount of reduction per unit length in the casting direction (i.e., the amount of reduction or tapering between the rolls).

The other fact relates to the amount of reduction that is necessary and sufficient for compensation of the shrinkage due to solidification (this amount is hereinafter referred to as the appropriate or optimum amount of reduction).

As is clear from the findings of the inventors of the present invention, an excessive reduction in thickness increases the center segregation, so that the reduction rate must be kept to an amount necessary for compensating the shrinkage due to solidification without any excess or deficiency. As is disclosed in the above U.S. Pat. No. 3,974,559, hitherto permitted is the fact that the reduction rate may be at least the amount necessary for compensating the shrinkage due to solidification, provided that no crack is produced inside the cast strand thus reduced in thickness. However, as is clear from the findings of the inventors, if the actual amount of the reduction rate is larger than the above-defined appropriate amount, a reverse V segregation will occur which points opposite to the casting direction and is directed to the meniscus in the mold. On the other hand, if the actual amount of the reduction rate is smaller than such appropriate amount, the V segregation pointing to the casting direction will occur together with a fluidization of molten steel also directed to the casting direction of the cast strand, as known hitherto. Consequently, it is necessary to keep the reduction rate in the above appropriate amount without any excess or deficiency.

Figure 1:
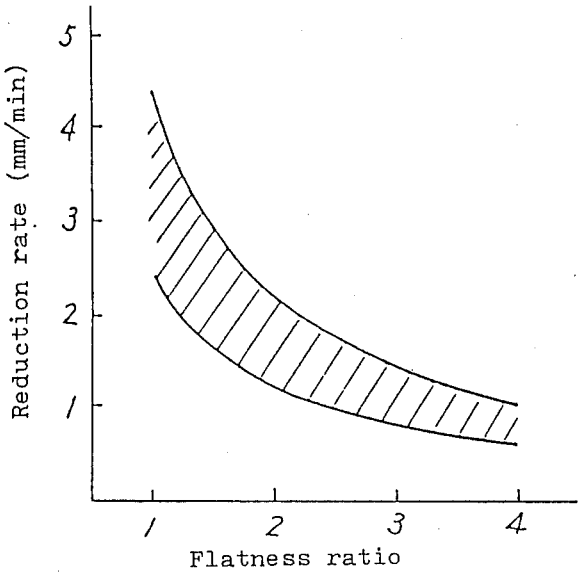
FIG. 1 is a diagram illustrating the relationship between the flatness ratio and the reduction rate.

The appropriate amount of the reduction rate for compensating the shrinkage due to solidification varies when the casting conditions of the cast strand such as its size and casting speed vary. As a result, hitherto, the appropriate amount of the reduction rate was empirically determined on the basis of typical operation conditions so that it was not universally applicable. Under such circumstances, the systematic research of the present inventors was repeatedly conducted on the appropriate amount of the reduction rate to find the fact that: when the appropriate amount of the reduction rate is represented by the reduction speed, such appropriate amount becomes a constant which is substantially not dependent on the casting speed of the cast strand; and this makes it clear that the remaining largest factor is the size of the cast strand. Namely, as shown in FIG. 1 in hatching, the appropriate amount of reduction rate (hatched portion) is largely dependent on the flatness ratio of the cast strand as shown in the following equation (1):

$$0.6\xi \leqq x \leqq 1.1\xi \qquad (1)$$

where $\xi = 4/r$, $1 \leqq r \leqq 4$, r is the flatness ratio of the strand, x is the reduction rate (mm/min).

When the reduction rate deviates from this appropriate amount, the segregation increases.

In the above equation (1), a strand having a flatness ratio of up to about 2 is termed "bloom" or "billet", while a strand having a flatness ratio of more than 2 is generally termed "slab".

The present invention is applied to the cast strand having a flatness ratio of up to 4 such as the slab, bloom and billet. As for a cast strand having a flatness ratio of more than 4, the appropriate amount of reduction rate does not change even when the flatness ratio is increased. Consequently, the present invention, which is based on a technical idea that the reduction rate is changed as the flatness ratio changes, is not adaptable to such cast strand having the flatness ratio of more than 4.

Now will described the region to which the reduction rate is applied.

Hitherto, it is considered that the center segregation occurs as a result of fluidization of the molten steel within the region between the point of time when the center of the cast strand has the liquidus-line temperature and the point of time when the cast strand acquires the solidus-line temperature (i.e., the region where both solid and liquid phases exist in the cast strand). Consequently, it was natural to consider that the reduction in thickness is applied to the entire area of such region. However, in the research of the inventors of the present invention, in case that the reduction in thickness is applied to the entire area of such region, it was sometimes observed that such reduction in thickness was insufficient or too little to improve the problem of center segregation of the cast strand. Therefore, in order to effectively improve the problem of center segregation, according to the findings, inventors of the it is important that the thickness of the cast strand is continuously reduced without any excess or deficiency so as to compensate the shrinkage due to solidification in the region between the point of time when the center of the strand has a temperature corresponding to a solid-phase ratio of 0.1 to 0.3 and the point of time when said temperature has dropped to a level corresponding to the solid-phase ratio at the limit of fluidization.

The inventors found the following facts on the basis of many experimental results: (1) the gap between upper and lower rolls of each of the roll pairs in the continuous casting machine experiences some offset from the preset value during casting (this offset is hereinafter referred to as dynamic misalignment); (2) the dynamic misalighment occurs as a result of the chattering of the bearing, the difference in the reaction force that develops in the direction of the width of the cast strand, and the deflection of rolls or roll bending by heat; and (3) the greater the reaction force that is exerted on the rolls by the strand (i.e., the greater the amount of reduction in the thickness of the cast strand), the greater the dynamic misalignment that develops, leading to another cause of fluidization of the molten steel to increase the chance of center segregation. The net effect of reducing the thickness of the cast strand in decreasing the center segregation is expressed as the difference between the positive effect achieved by compensation of the shrinkage due to solidification and the negative effect caused by increased dynamic misalignment. Consequently, in order to improve the problem of segregation under light reduction conditions, it is most important to uniformly reduce the thickness of the cast strand in its width direction over an appropriate region thereof by the use of rolls having been adjusted to minimize the dynamic misalignment.

According to the findings of the present inventors, the effect of reducing the thickness of the cast strand in decreasing the amount of segregation is greater in the downstream region where the center of the cast strand has a high solid-phase ratio, and small in the upstream region. As a result, in a region located upstream of the point of time when the center of the cast strand has a temperature corresponding to a solid-phase ratio of 0.1 to 0.3, the effect of reduction in thickness of the cast strand under light reduction conditions on the center segregation is small. In this case, if the dynamic misalignment is not kept extremely small, the problem of the center segregation increases. Consequently, in such region, it is essentially preferable to conduct no reduction in thickness of the cast strand. If the reduction in thickness of the cast strand is conducted in this region, it is preferable to keep the reduction rate within a range of less than 0.5 mm/min. On the other hand, in a region where the reduction in thickness of the cast strand is conducted, it is necessary to strengthen a supporting frame for the rolls in order to bear a reaction force caused by reduction in thickness of the cast strand, which increases construction cost of the continuous casting machine. Therefore, in the above-mentioned region located upstream of the point of time when the center of the cast strand has the temperature corresponding to the solid-phase ratio of 0.1 to 0.3, it is possible to conduct no reduction in thickness of the cast strand, which leads to cost reduction in construction to produce an economical effect.

In a region which is located downstream of the point of time when the center of the cast strand has a temperature corresponding to a solid-phase ratio at the limit of fluidization and is located upstream of the point of time when said temperature has dropped to a level corresponding to the solid phase of the cast strand, there occurs no fluidization when the shrinkage due to solidification occurs, because the molten parts of the center of the cast strand are separated from each other through the solid phase arts of the center of the cast strand. Consequently, there is no need to conduct the reduction in thickness of the cast strand in such region. On the other hand, when an excessive reduction in thickness of the cast strand is conducted in this region, the center segregations are often transformed into linear segregations. The linear segregation is easily produced when a solidified structure becomes a columnar (or a pillar-shaped) crystal, while it is hardly produced when it becomes an equiaxial structure. However, such linear segregation has a network-like form which makes it easy to produce a hydrogen-induced crack in the final product, so that the linear segregation is harmful for the final product. Consequently, it is important to prevent the center segregation from having the linear form when the reduction in thickness of the cast strand is conducted under light conditions. In order to cause the center segregation to become a form of tiny separate spots which is most advantageous or least deleterious to the final product, substantially no reduction in thickness should be conducted in this region. If it is conducted in this region, the reduction rate is preferably less than 0.5 mm/min.

In consideration of the above facts, the region in which the reduction in thickness of the cast strand must be conducted according to the method of the present invention is a region between the point of time when the center of the cast strand has a temperature corresponding to a solid-phase ratio of 0.1 to 0.3 and the point of time when said temperature has dropped to a level corresponding to the solid-phase ratio at the limit of fluidization. In case that the dynamic misalignment is so small that the negative effect of the reduction in thickness is substantially negligible, or in case that the reduction rate is within a range of less than 0.5 mm/min, it is possible to conduct the reduction in thickness in a region located upstream of the above-mentioned region. Moreover, in cast that the linear segregation form is not deleterious to the final product in use or that the reduction rate is within a range of less than 0.5 mm/min, it is possible to conduct the reduction in thickness in a region located downstream of the above mentioned region.

EXAMPLE

Now, the present invention will be described with reference to an example.

A molten steel prepared in a converter was continuously cast into: a slab of a 240-mm thickness by a 960-mm width as to sample Nos. A, B and C; a slab of a 240-mm thickness by a 720-mm width as to sample Nos. D, E and F; a bloom of a 300-mm thickness by a 500-mm width as to sample Nos. G, H and I; a bloom of a 350-mm thickness by a 560-mm width as to sample Nos. J and K; and a billet of a 215-mm thickness by a 215-mm width as to sample Nos. L, M, N and O. From these slabs, blooms and billets were then produced heavy plates and wire rods through rolling processes. The following Table 1 shows the composition of each of the sample Nos. A, B, C, D, E and F, while the following Table 2 shows the composition of each of the sample Nos. G, H, I, J, K, L, M, N and O.

Samples were taken from the cast strand and investigation was conducted as to the index of the center segregation and the number of the V segregations. Incidentally, the index of the center segregation denotes the index of the thickness of a segregation spot where the Mn concentration in steel was at least 1.3 times the value obtained by analysis in the ladle; the higher this index, the greater the segregation of the impurity elements in the steel. The results are summarized in the following Table 3.

TABLE 1

Composition of Sample Nos. A, B, C, D, E and F (wt. %)

| C | Si | Mn | P | S | Al | Cu | Ni | Ti | V | Ca | N |
|---|---|---|---|---|---|---|---|---|---|---|---|
| 0.10 | 0.25 | 1.29 | 0.008 | 0.001 | 0.025 | 0.16 | 0.21 | 0.018 | 0.04 | 0.0025 | 0.0033 |

TABLE 2

Composition of Sample Nos. G, H, I, J, K, L, M, N and O (wt. %)

| C | Si | Mn | P | S | Al | N |
|---|---|---|---|---|---|---|
| 0.71 | 0.22 | 0.75 | 0.013 | 0.003 | 0.032 | 0.0034 |

TABLE 3

| Sample No. | Conditions and Results of Tests: Flatness ratio | Rate of reduction (mm/min) | Number of V or r-V segregations per m | Index of center segregation |
|---|---|---|---|---|
| Present invention | | | | |
| A | 4.0 | 0.9 | 0 | 0.2 |
| B | 4.0 | 0.8 | 0 | 0.1 |
| D | 3.0 | 1.0 | 0 | 0.4 |
| G | 1.7 | 1.6 | 0 | 1.8 |
| H | 1.7 | 2.1 | 0 | 2.0 |
| J | 1.6 | 2.2 | 0 | 1.4 |
| L | 1.0 | 3.0 | 0 | 2.5 |
| M | 1.0 | 3.5 | 0 | 1.8 |
| Sample Comparative | | | | |
| C | 4.0 | 1.5 | 15 of r-V | 1.5 |
| E | 3.0 | 0.6 | 15 of V | 1.3 |
| F | 3.0 | 1.8 | 10 of r-V | 2.0 |
| I | 1.7 | 1.3 | 15 of V | 4.0 |
| K | 1.6 | 3.0 | 10 of r-V | 4.6 |
| N | 1.0 | 2.2 | 20 of V | 7.0 |
| O | 1.0 | 5.0 | 15 of r-V | 7.5 |

Remarks:
V: V segregation; and
r-V: reverse V segregation

As shown in FIG. 1 and Table 3, the reduction in thickness of each of the sample Nos. A, B, D, G, H, J, L and M was conducted at the appropriate reduction rate within the range of the flatness ratio of the strand according to the present invention, so each of the samples prepared according to the method of the present invention was small in both the number of V or reverse V segregations and the index of the center segregation. In contrast with this, in each of the sample Nos. C, E, F, I, K, N and O which are the comparative samples, V or reverse V segregations developed, and the number thereof and the index of center segregation were large, because it was subjected to the reduction in thickness conducted at an inadequate reduction rate. As a result, it is recognized that any of these comparative samples is remarkably inferior to the samples prepared according to the present invention. In addition, although it is recognized that each of the comparative samples tends to increase the segregation as the flatness ratio is lowered, the samples prepared according to the method of the present invention have substantially no such tendency to keep the segregation level low, so it was proved that in this respect, the present invention is superior to the comparative invention.

Incidentally, each of the sample Nos. A, B, D, G and H was prepared with the use of a reduction rate of less than 2.5 mm/min.

In the present invention as described above, when the flatness ratio of the cast strand changes, an appropriate amount of reduction rate is applied depending on the change, so that the segregation in the center of the strand does not exert a bad influence and it is possible to control any of the number of the V or the reverse V segregations and the index of the center segregation within an adequate range. This is an excellent effect inherent in the method of the present invention.

What is claimed is:

1. A method of continuously casting molten metal, which comprises continuously drawing a strand wherein that a thickness of said strand is continuously reduced at a reduction rate in a region between a point of time when a center of said strand has a temperature corresponding to a solid-phase ratio of 0.1 to 0.3 and a point of time when said temperature has dropped to a level corresponding to a solid-phase ratio at a limit of fluidization, provided that said reduction rate satisifes the following equation (1):

$$0.6\xi \leqq x \leqq 1.1\xi \quad (1)$$

where $\xi=4/r,\ 1\leqq r\leqq 4,$ r is a flatness ratio of the strand, x is a reduction rate (mm/min).

2. The method as set forth in the claim 1, wherein said solid-phase ratio at said limit of fluidization is within a range of 0.6 to 0.9.

3. The method as set forth in the claim 1 wherein said molten metal is a steel.

4. The method as set forth in the claim 1, wherein said reduction rate is more than 2.5 mm/min while kept within a range satisfying said equation (1).

5. The method as set forth in the claim 4, wherein said solid-phase ratio at said limit of fluidization is within a range of 0.6 to 0.9.

6. The method as set forth in the claim 4, wherein said molten metal is a steel.

7. The method as set forth in the claim 1, wherein said reduction rate is less than 2.5 mm/min while kept within a range satisfying said equation (1).

8. The method as set forth in the claim 7, wherein said solid-phase ratio at said limit of fluidization is within a range of 0.6 to 0.9.

9. The method as set forth in the claim 7, wherein said molten metal is a steel.

* * * * *

UNITED STATES PATENT AND TRADEMARK OFFICE

CERTIFICATE OF CORRECTION

PATENT NO. : 4,747,445

DATED : May 31, 1988

INVENTOR(S) : Shigeaki OGIBAYASHI and Kenichi MIYAZAWA

It is certified that error appears in the above-identified patent and that said Letters Patent is hereby corrected as shown below:

Column 8, line 58, delete "that".

Signed and Sealed this

Eighth Day of November, 1988

*Attest:*

DONALD J. QUIGG

*Attesting Officer*

*Commissioner of Patents and Trademarks*